US012345486B2

(12) United States Patent
Larson, Jr.

(10) Patent No.: US 12,345,486 B2
(45) Date of Patent: Jul. 1, 2025

(54) FIREARM CARTRIDGE EJECTOR

(71) Applicant: Rock River Arms, Inc., Colona, IL (US)

(72) Inventor: Lester C. Larson, Jr., Colona, IL (US)

(73) Assignee: Rock River Arms, Inc., Colona, IL (US)

( * ) Notice: Subject to any disclaimer, the term of this patent is extended or adjusted under 35 U.S.C. 154(b) by 28 days.

(21) Appl. No.: 18/177,939

(22) Filed: Mar. 3, 2023

(65) Prior Publication Data

US 2023/0384048 A1 Nov. 30, 2023

Related U.S. Application Data

(60) Provisional application No. 63/316,232, filed on Mar. 3, 2022.

(51) Int. Cl.
*F41A 15/14* (2006.01)

(52) U.S. Cl.
CPC ..... *F41A 15/14* (2013.01)

(58) Field of Classification Search
CPC ..... F41A 15/14
See application file for complete search history.

(56) References Cited

U.S. PATENT DOCUMENTS

| | | | | |
|---|---|---|---|---|
| 8,826,576 | B2 | 9/2014 | Lewis | |
| 9,057,572 | B2 | 6/2015 | Matteson | |
| 11,846,476 | B2 * | 12/2023 | Underwood | F41A 3/26 |
| 2021/0108870 | A1 * | 4/2021 | Underwood | F41A 3/46 |
| 2022/0003512 | A1 * | 1/2022 | Underwood | F41A 3/62 |
| 2024/0035768 | A1 * | 2/2024 | Gagne | F41A 15/14 |

* cited by examiner

*Primary Examiner* — Michelle Clement
(74) *Attorney, Agent, or Firm* — Banner & Witcoff, Ltd.

(57) ABSTRACT

A firearm cartridge ejector system is disclosed that may include a bolt or a bolt carrier group, and an ejector that may be configured to eject an ammunition cartridge from the firearm bolt or bolt carrier group. The ejector may further include a stem configured to engage an ejector spring, and an ejector face that may be reniform-shaped and attached to the stem and configured to engage and eject the ammunition cartridge.

20 Claims, 12 Drawing Sheets

FIREARM CARTRIDGE EJECTOR

CROSS-REFERENCE TO RELATED APPLICATIONS

This application claims priority to U.S. Provisional Application No. 63/316,232, filed Mar. 3, 2022, which is incorporated by reference herein in its entirety.

TECHNICAL FIELD

This disclosure relates to the field of firearm ammunition cartridge ejectors and methods of making firearm cartridge ejectors. The disclosure particularly relates to a novel ammunition ejector with a new design for an ejector face compatible with a firearm bolt and/or a firearm bolt carrier group.

BACKGROUND

Conventional bolt carrier groups are typically found in firearms using a gas operated mechanism to cycle ammunition. Bolt carrier groups include components to control the extraction of an expended ammunition cartridge, re-cocking the firearm, and loading a new cartridge. Conventional bolt carrier groups and bolts typically employ an extractor to remove a cartridge from the barrel and an ejector to eject the cartridge from the bolt carrier group or bolt and out of the chamber area. Conventional ejectors have known problems such as failure to adequately eject rounds from the bolt carrier group or bolt causing ammunition loading failures such as failures to feed, stove-pipes, double-feeds, and other issues that cause the weapon to jam. Other known issues include ejectors that damage the ammunition brass or steel casing resulting in an inoperable casing unusable for reloading purposes. The known problems of ejectors are observed in all ammunition types and, in particular, in ammunition related to higher caliber weapons such as .308 Winchester, 7.62×51 mm NATO, and .338 Lapua. Accordingly, there is a need for an ammunition ejector that addresses known ejection problems and overcomes the limitations of prior art devices.

SUMMARY

This Summary introduces a selection of concepts relating to this technology in a simplified form as a prelude to the Detailed Description that follows. This Summary is not intended to identify key or essential features.

In some aspects, a firearm cartridge ejector system is disclosed that may include a bolt or a bolt carrier group, an ejector that may be configured to eject a cartridge from the firearm bolt or bolt carrier group. In some examples, the ejector may be movably or slidably engaged with an ejector cylinder positioned in the bolt or bolt carrier group. In other examples, an ejector spring may be included that may be configured to bias the ejector. In still other examples, the ejector may further include a stem configured to engage the ejector spring, and an ejector face attached to the stem and configured to engage the ammunition cartridge. In yet another example, the ejector face may be reniform-shaped.

In other examples, the ejector may be constructed of a polymer, a metal, an alloy, or combinations thereof. In another example, the ejector face may be planar. In still another example, the ejector face may be flat. In yet other examples, the ejector face may be curved. In other examples, the ejector face may be concave. In some examples, the ejector face may be convex.

In another example, the ejector stem may be positioned perpendicular to the ejector face, and the stem may extend proximally from a rear side of the ejector face. In some examples, the stem may include a notch configured to engage an ejector roll pin. In some examples, the ejector is removably engaged with the bolt or the bolt carrier group. In still other examples, an interior portion of the ejector face proximate the firing pin may be concave. In another example, the interior portion of the ejector face may also include a protrusion positioned between a first end of the ejector face and a second end of the ejector face. In some examples, the protrusion may extend towards the firing pin. In certain examples, the protrusion may be convex and/or curvilinear. In another example, the ejector face may include a plurality of ridges and/or grooves. In other examples, a firearm may include the firearm cartridge ejector system disclosed herein.

In other aspects, a firearm cartridge ejector is disclosed that may include a stem configured to removably engage an ejector spring and an ejector cylinder, an ejector face attached to the stem that may include an ejector face that may be reniform-shaped. In certain examples, the firearm cartridge ejector may be configured to engage a bolt or a bolt carrier group. In some examples, the ejector may be a polymer, a metal, an alloy, or combinations thereof. In other examples, the ejector face may be nonplanar or planar. In still other examples, an interior portion of the ejector face may be concave. In another example, the interior portion of the ejector face may also include a protrusion positioned between a first end of the ejector face and a second end of the ejector face. In yet other examples, the protrusion may be convex and/or curvilinear.

In still other aspects, a firearm cartridge extraction system is disclosed that may include a bolt carrier group configured to insert, extract, and eject a firearm cartridge from a weapon. In some examples, the bolt carrier group may also include a bolt and an ejector. In other examples, the ejector may include an ejector stem configured to slidably engage the bolt, and an ejector face attached to the ejector stem and configured to eject the firearm cartridge from the bolt. In some examples, the ejector face may be reniform-shaped.

These and other features, advantages, and objects of the present disclosure will be further understood and appreciated by those skilled in the art by reference to the following specification, claims, and appended drawings, where various embodiments of the design illustrate how concepts of this disclosure may be used.

BRIEF DESCRIPTION OF THE DRAWINGS

A more complete understanding of features described herein and advantages thereof may be acquired by referring to the following description in consideration of the accompanying drawings, in which like reference numbers indicate like features.

DETAILED DESCRIPTION

In the following description of the various embodiments, reference is made to the accompanying drawings identified above and which form a part hereof, and in which is shown by way of illustration various embodiments in which features described herein may be practiced. It is to be understood that other embodiments may be utilized and structural and functional modifications may be made without departing from the scope described herein. Various features are capable of other embodiments and of being practiced or being carried out in various different ways.

Conventional bolt carrier groups and bolts typically incorporate a rod-shaped ejector and may be constructed of metals, alloys, and combinations thereof. Problems resulting from conventional ejectors may be attributed to the rod-shaped design and the minimal surface area of the ejector face leading to ineffective ammunition cartridge ejections. The smaller surface area of a conventional ejector face may be especially problematic for higher caliber ammunition types such as .308 Winchester, 7.62×51 mm NATO, and .338 Lapua. The ejector and ejector face disclosed herein, surprisingly, generates minimal malfunctions and performs far superior to conventional ejectors. In particular, the unique shape and reinforced design of the ejector and ejector face disclosed herein ejects spent ammunition more reliably than conventional systems.

Figure 1:
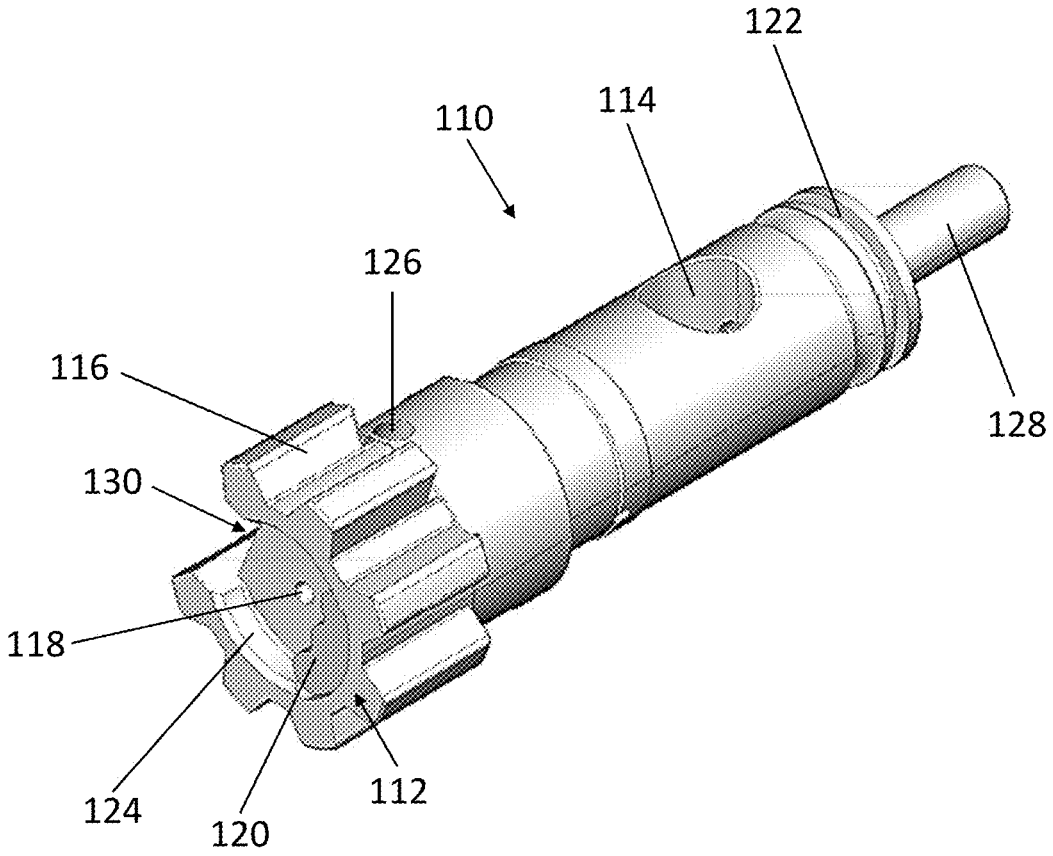
FIG. 1 is a right perspective view of a firearm bolt disclosed herein.

FIG. 1 is a right perspective view of a firearm bolt 110 comprising such an ejector 120. The example bolt 110 may include a bolt face 112, bore 114, at least one, or multiple, gas ring slots or grooves 122. The example bolt 110 may also include multiple lugs 116, firing pin 118, and cartridge recess 124. The bolt 110 may also include extractor pin cylinder 126, bolt stem 128, and extractor recess 130. The gas ring slot or slots 122 may be integrally formed with the bolt stem 128. As described more fully below, the example bolt 110 may include a reinforced ejector 120 mounted to the bolt. The components of the bolt may be formed of metals, metal alloys, polymers, or combinations thereof.

Figure 2:
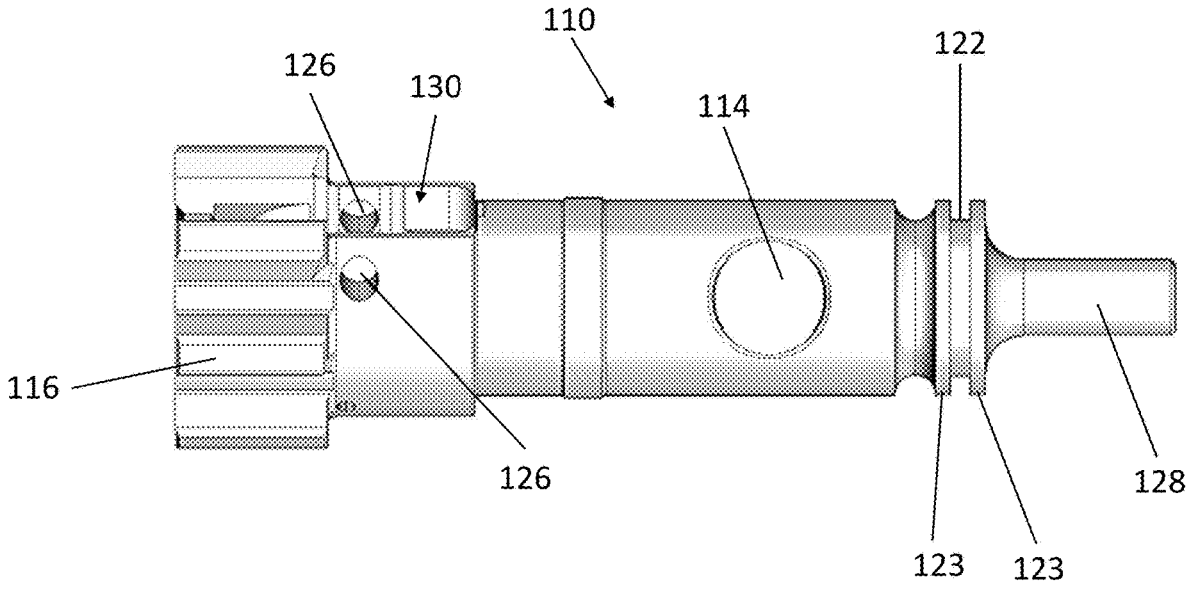
FIG. 2 is a side view of the firearm bolt of FIG. 1.

FIG. 2 is a side view of the example firearm bolt 110. The gas ring slot 122 may be formed by flanges 123. The example bolt 110 may also include extractor pin cylinder 126 and extractor recess 130.

Figure 3:
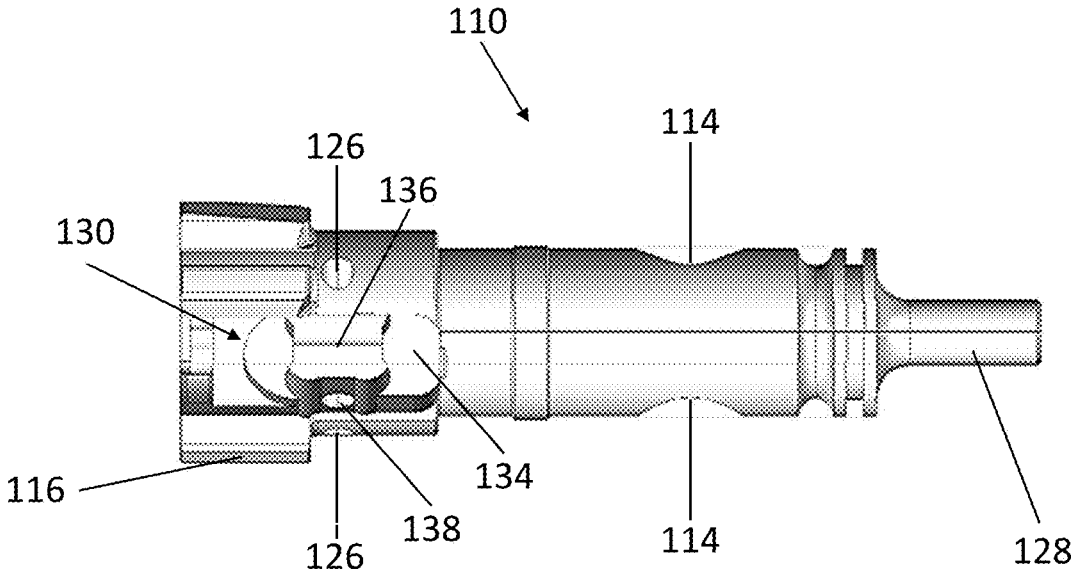
FIG. 3 is a 90° rotated and partial sectional view of the firearm bolt of FIG. 2.

FIG. 3 is a partial sectional view and rotated 90° of the example firearm bolt 110 illustrated in FIG. 2. As previously disclosed, the bolt 110 may include extractor recess 130 configured to engage an extractor (not shown). The extractor may be pivotably engaged in recess 130 formed in the bolt. The extractor may be configured to engage a spring and the extractor may be further configured to releasably engage an ammunition cartridge as it is placed in a weapon firing chamber. When the weapon is fired, the interlocked bolt 110 receives the recoil force that is transmitted from the bolt face 112 to the lugs 116. The lugs 116 in turn transmit the recoil force to corresponding lugs of the barrel extension. Once the round is fired, the bolt 110 unlocks from the barrel extension and the bolt 112 and/or bolt carrier group recoils. As the bolt 110 recoils, the extractor pulls the expended ammunition cartridge from the firing chamber. The firearm cartridge ejector 120 may engage an ejector spring. The ejector spring may be configured to bias the ejector 120 to an extended position. The spring-loaded ejector 120 may be compressed by the cartridge held in place by the extractor. When the bolt removes the entire cartridge from the barrel extension, the ejector 120 may be configured to move to an extended position by the spring. The cartridge is subsequently ejected by the extended ejector 120 and another ammunition cartridge may be chambered by the bolt 110 and/or bolt carrier group. This process may then be repeated as often as desired by the shooter until the last ammunition cartridge is expended. As shown in FIG. 3, the extractor recess 130 may also include bolt cam slot 134. Bolt cam slot 134 may be configured to engage bolt cam 136. Bolt cam 136 may include bolt cam cylinder 126 configured to engage a bolt cam pin.

Figure 4:
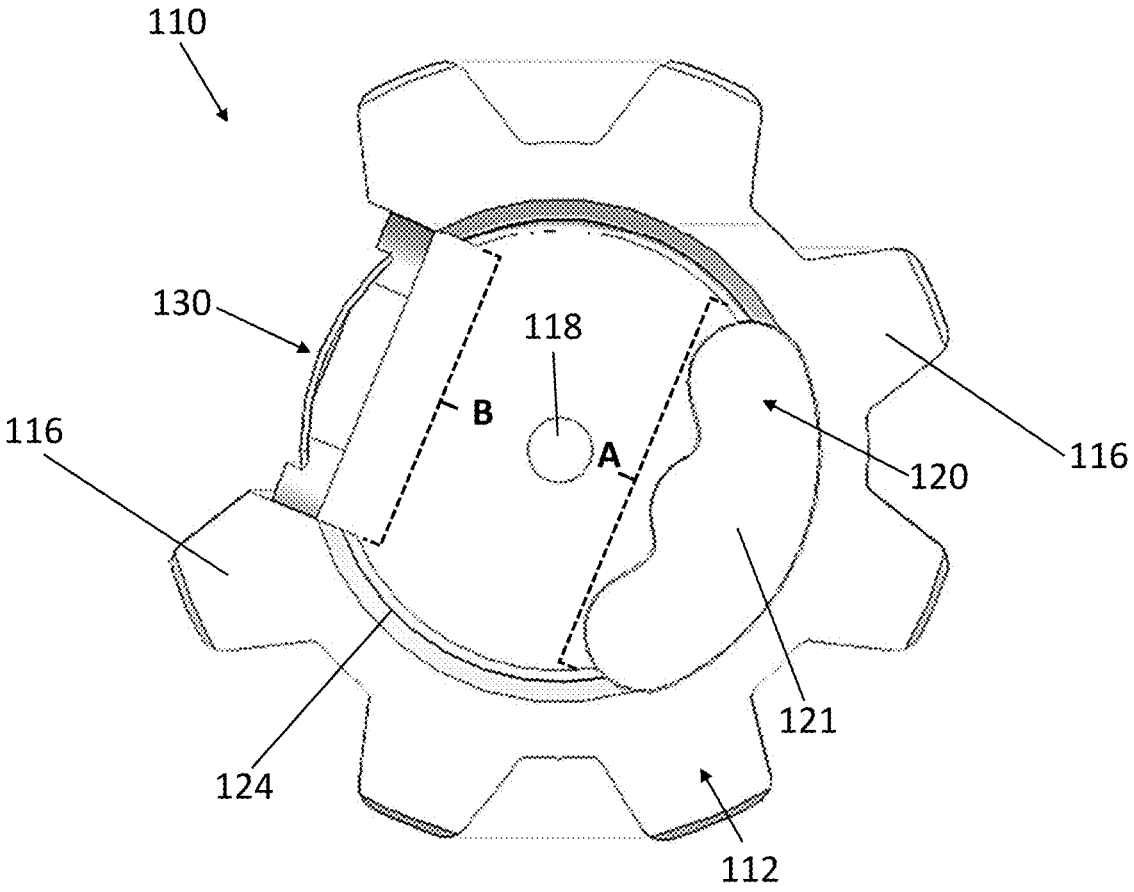
FIG. 4 is a rear view of a firearm bolt disclosed herein.

FIG. 4 is a rear view of the example firearm bolt 110 disclosed herein. The firearm cartridge ejector 120 may include an ejector face 121. In certain examples, the bolt face 121 may be reniform-shaped. The ejector 120 is depicted in the extended position and the ejector face 121 may be flush with the bolt face 112. In some examples, the ejector face 121 may include a width A. In other examples, the extractor recess 130 may include a width B. In other examples, the ejector face 121 width A may be greater than, less than, or equal to the extractor recess 130 width B. In some examples, the ejector face 121 width may be, for example, at least, greater than, less than, equal to, or any number in between about 0.001 through 100 millimeters. In one example, the ejector face 121 width A may be about, at least, greater than, less than, equal to, or any number in between about 0.475 inches, 0.476 inches, 0.477 inches, 0.478 inches, 0.479 inches, 0.480 inches, 0.481 inches, 0.482 inches, 0.483 inches, 0.484 inches, 0.485 inches, 0.486 inches, 0.487 inches, 0.488 inches, 0.489 inches, 0.490 inches, 0.491 inches, 0.492 inches, 0.493 inches, 0.494 inches, 0.495 inches, 0.496 inches, 0.497 inches, 0.498 inches, 0.499 inches, 0.500 inches, 0.501 inches, 0.502 inches, 0.503 inches, 0.504 inches, 0.505 inches, 0.506 inches, 0.507 inches, 0.508 inches, 0.509 inches, 0.510 inches, 0.511 inches, 0.512 inches, 0.513 inches, 0.514 inches, 0.515 inches, 0.516 inches, 0.517 inches, 0.518 inches, 0.519 inches, 0.520 inches, 0.521 inches, 0.522 inches, 0.523 inches, 0.524 inches, and 0.525 inches. In another example, the ejector face 121 width A may be approximately 0.495 inches. In still another example, the ejector face 121 width A may be about 0.475 inches to about 0.525 inches. In other examples, the ejector 120 may be configured to movably engage an ejector cylinder positioned in the bolt 110.

Figure 5:
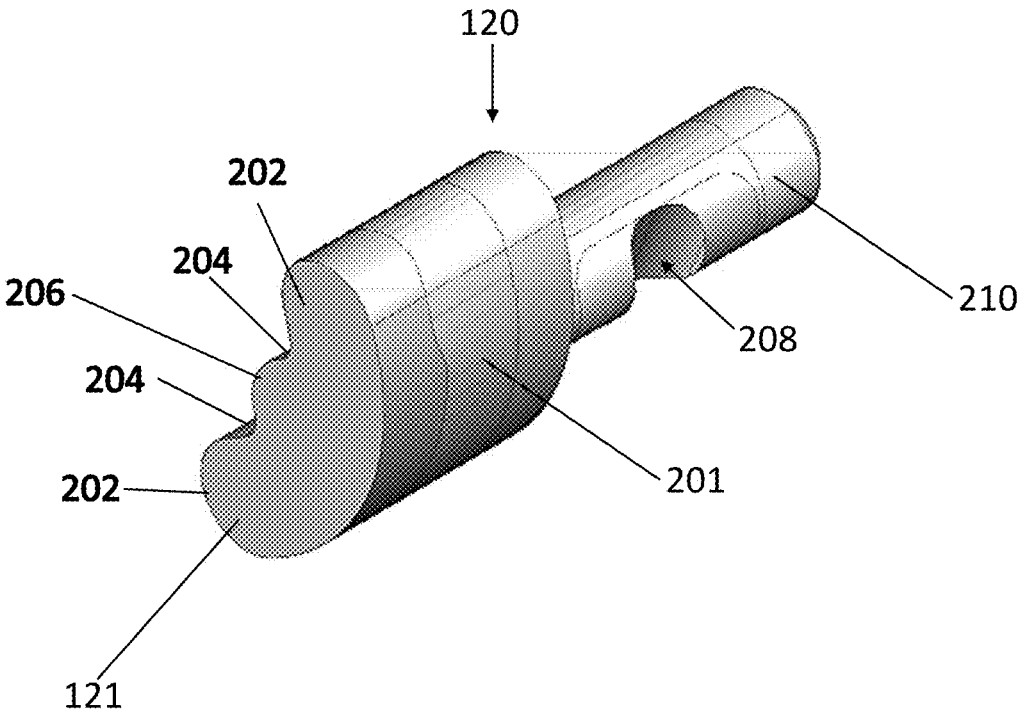
FIG. 5 is a rear-right perspective view of an ejector disclosed herein.

FIG. 5 is a rear-right perspective view of a firearm cartridge ejector 120 disclosed herein. The ejector 120 may include ejector face 121, head 201, and stem 210. The stem 210 may be positioned perpendicular to a rear side of the ejector face 121 and/or ejector head 201. Stem 210 may releasably engage an ejector spring and may include notch 208. Notch 208 may be configured to engage an ejector roll pin. Stem 210 may include a length extending proximally from the bottom of the ejector head 201 and opposite the face 121. The ejector head 201 may include a length extending from the ejector face 121 to the top of the stem 210. In some examples, the ejector head 201 length may be, for example, at least, greater than, less than, or equal to, the length of the stem.

Figure 6:
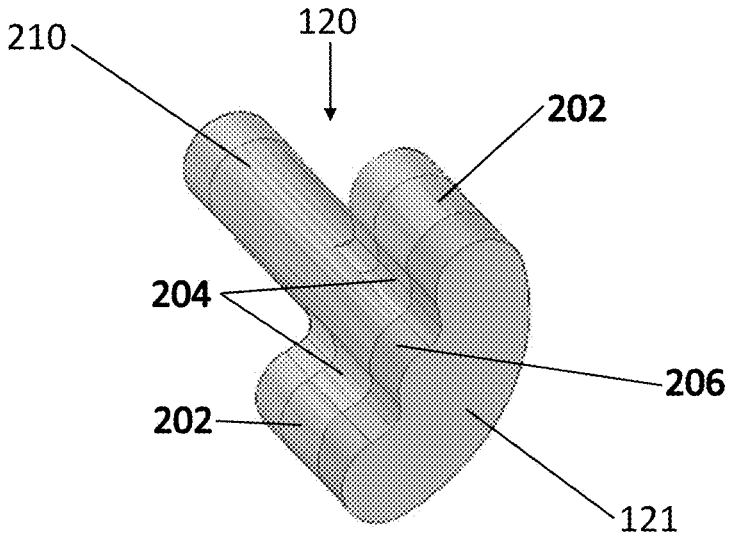
FIG. 6 is an opposite-side perspective view of the ejector of FIG. 5.

FIG. 6 is an opposite-side perspective view of the firearm cartridge ejector 120 shown in FIG. 5. Referring to FIGS. 5 and 6, in some examples, the ejector head 201 and ejector face 121 may include an interior portion that may be generally concave and/or curved or curvilinear. In some examples, the ejector face 121 and head 201 may include at least two ridges 202, and at least two grooves 204 positioned on the interior side of the ejector 120. In other examples, the ejector face 121 and head 201 may include a protrusion 206 that may be positioned between a first end of the ejector face 121 and a second end of the ejector face 121. In still other examples, the protrusion 206, grooves 204, and ridges 202 may extend from the ejector face 121 to a bottom of the ejector head 201 as shown in FIG. 6. In some examples, the protrusion 206 may have a curvature similar or the same as the curvature of the stem 210. The protrusion 206 and/or the ridges 202 may be convex and/or curvilinear. The shape and design features of the ejector 120, as also discussed above, are directly related to surprising and unexpected performance in the ejection of ammunition cartridges and the minimization of ejection failures.

Figure 7:
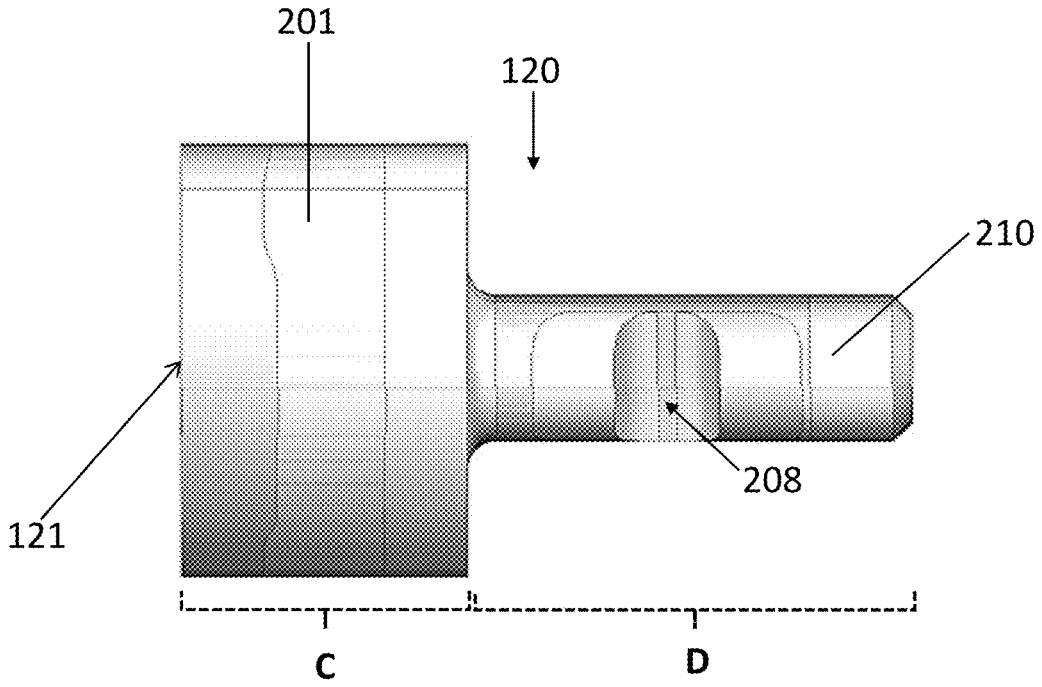
FIG. 7 is a side view of the ejector of FIG. 5.
Figure 8:
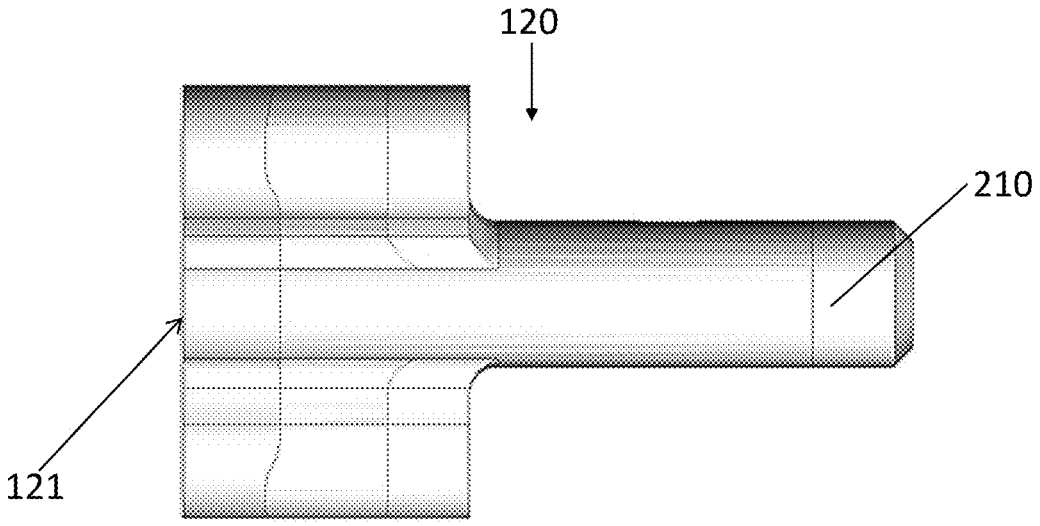
FIG. 8 is the opposite-side view of the ejector of FIG. 7.

FIG. 7 is a side view of the example firearm cartridge ejector 120 as disclosed herein. FIG. 8 is the opposite-side view of the example ejector 120 of FIG. 7. As shown in FIG. 7 and discussed above, the ejector 120 may include an ejector head length C measured from the ejector face 121 to the bottom of the ejector head 201. In another example, the ejector 120 may also include an ejector stem 210 length D measured from the bottom of the ejector head 201 to the end of the stem 210. In some examples, the ejector head 201 length C may be, for example, at least, greater than, less than, equal to, or any number in between about 0.001 through 100 millimeters. In other examples, the ejector stem 210 length D may be, for example, at least, greater than, less than, equal to, or any number in between about 0.001 through 100 millimeters. In some examples, the ejector head 201 length C may be at least, greater than, less than, equal to, or any number in between about 0.200 inches, 0.201 inches, 0.202 inches, 0.203 inches, 0.204 inches, 0.205 inches, 0.206 inches, 0.207 inches, 0.208 inches, 0.209 inches, 0.210 inches, 0.211 inches, 0.212 inches, 0.213 inches, 0.214 inches, 0.215 inches, 0.216 inches, 0.217 inches, 0.218 inches, 0.219 inches, 0.220 inches, 0.221 inches, 0.222 inches, 0.223 inches, 0.224 inches, 0.225 inches, 0.226 inches, 0.227 inches, 0.228 inches, 0.229 inches, 0.230 inches, 0.231 inches, 0.232 inches, 0.233 inches, 0.234 inches, 0.235 inches, 0.236 inches, 0.237 inches, 0.238 inches, 0.239 inches, and 0.240 inches. In another example, the ejector head 201 length C may be approximately 0.220 inches. In other examples, the ejector stem 210 length D may be may be at least, greater than, less than, equal to, or any number in between about 0.470 inches, 0.471 inches, 0.472 inches, 0.473 inches, 0.474 inches, 0.475 inches, 0.476 inches, 0.477 inches, 0.478 inches, 0.479 inches, 0.480 inches, 0.481 inches, 0.482 inches, 0.483 inches, 0.484 inches, 0.485 inches, 0.486 inches, 0.487 inches, 0.488 inches, 0.489 inches, and 0.490 inches. In yet another example, the ejector stem 210 length D may be approximately 0.480 inches.

Figure 9:
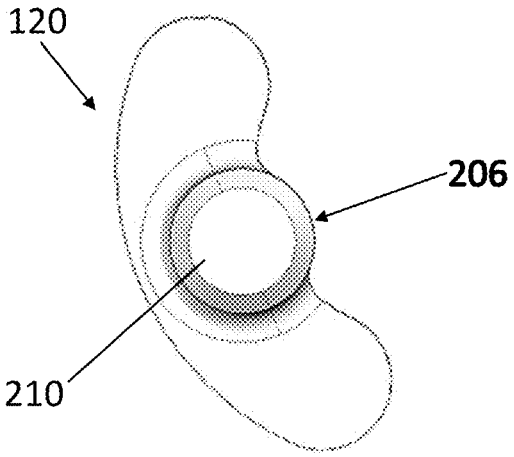
FIG. 9 is a bottom view of the ejector face and ejector head of FIG. 5.

FIG. 9 is a bottom/rear view of the firearm cartridge ejector 120, face 121 and ejector head 201 from the end of the stem 210. As previously discussed, some examples of the protrusion 206 may have a curvature similar or the same as the curvature of the stem 210. The stem 210 may include a diameter that is the same as conventional ejectors. In certain examples, the ejector described herein may be compatible with conventional bolts and bolt carrier groups and may be used to replace or retrofit prior art ejectors in a firearm bolt.

Figure 10:
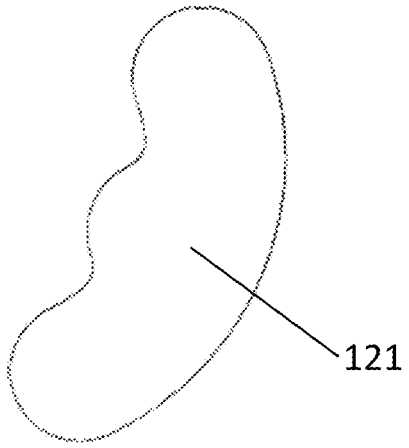
FIG. 10 is a planar view of an ejector face disclosed herein.

FIG. 10 is a planar view of an ejector face 121 of a firearm cartridge ejector 120 as disclosed herein. In some examples, the ejector face 121 may include a profile that is planar, curved, concave, convex, or nonplanar. In other examples, the ejector face 121 may include a profile or shape that resembles a kidney bean. In yet other examples, the ejector face may include a reniform-shaped profile.

Figure 11:
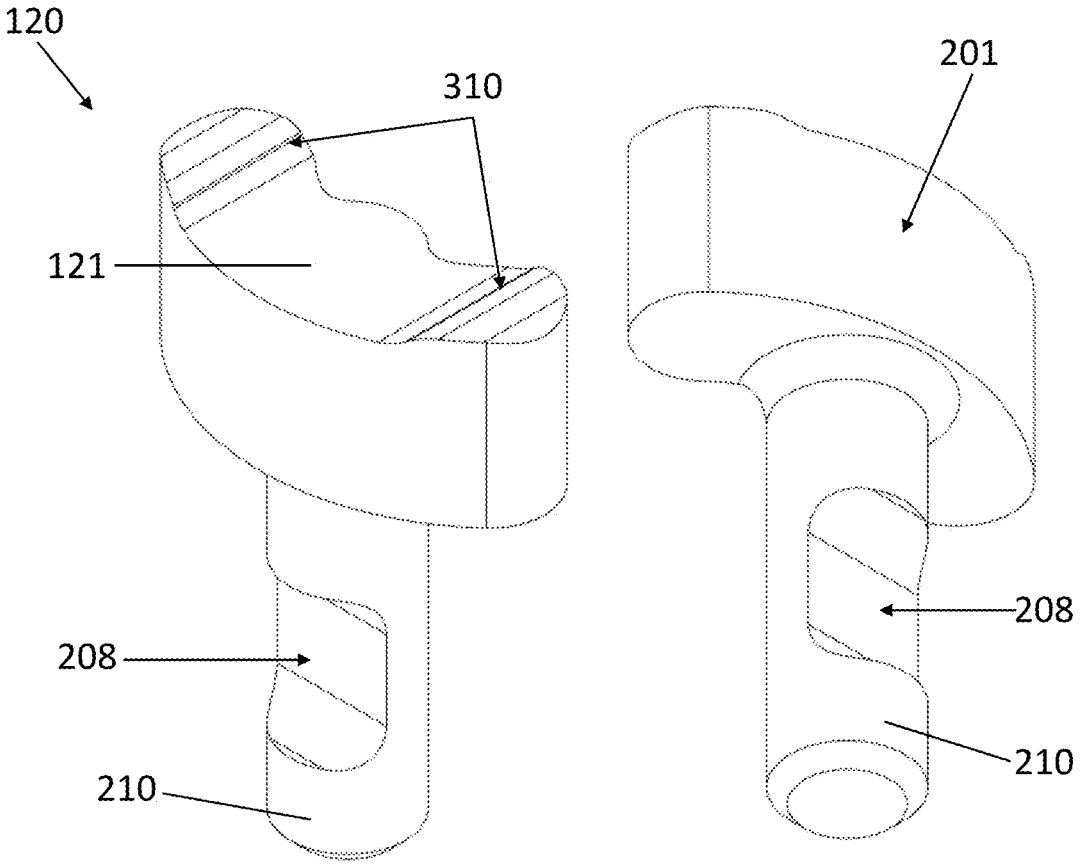
FIG. 11 depicts side-perspective views of an alternative ejector disclosed herein.

FIG. 11 depicts side-perspective views of an alternative firearm cartridge ejector 120. The ejector 120 may include ejector face 121, head 201, and stem 210. The stem 210 may be positioned perpendicular to a rear side of the ejector face 121 and/or ejector head 201, and the stem 210 may be configured to slidably engage a firearm bolt. Stem 210 may releasably engage an ejector spring and may include notch 208. Notch 208 may be configured to engage an ejector roll pin. The ejector 120 may include any or all of the features previously described. In some examples, the ejector face 121 may include a plurality of notches or grooves 310. In some examples, the notches or grooves 310 may be positioned across the entire face 121 of the ejector 120. In other examples, the notches 310 may be formed only in the opposing ends of the ejector face 310 as depicted in FIG. 11. In yet another example, the ejector face 121 may include a planar or flat portion in the center of the ejector face 121. In still other examples, the ejector face may include notches 310 and the ejector face 121 may be generally concave. In other examples, the ejector face 121 may include notches 310 and the ejector face 121 may generally planar. In one example, the notches 310 may be elevated or stair-stepped in relation to each other and above a lower middle portion of the ejector face 121. In certain examples, the ejector face 121 may include a number of notches or grooves 310 that is, for example, at least, greater than, less than, equal to, or any number in between about 0, 1, 2, 3, 4, 5, 6, 7, 8, 9, 10, 11, 12, 13, 14, 16, 17, 18, 19, 20, 30, 40 through 50. In one example, the notches or grooves 310 may be configured and positioned to form a crosshatch pattern on the ejector face 121.

Figure 12:
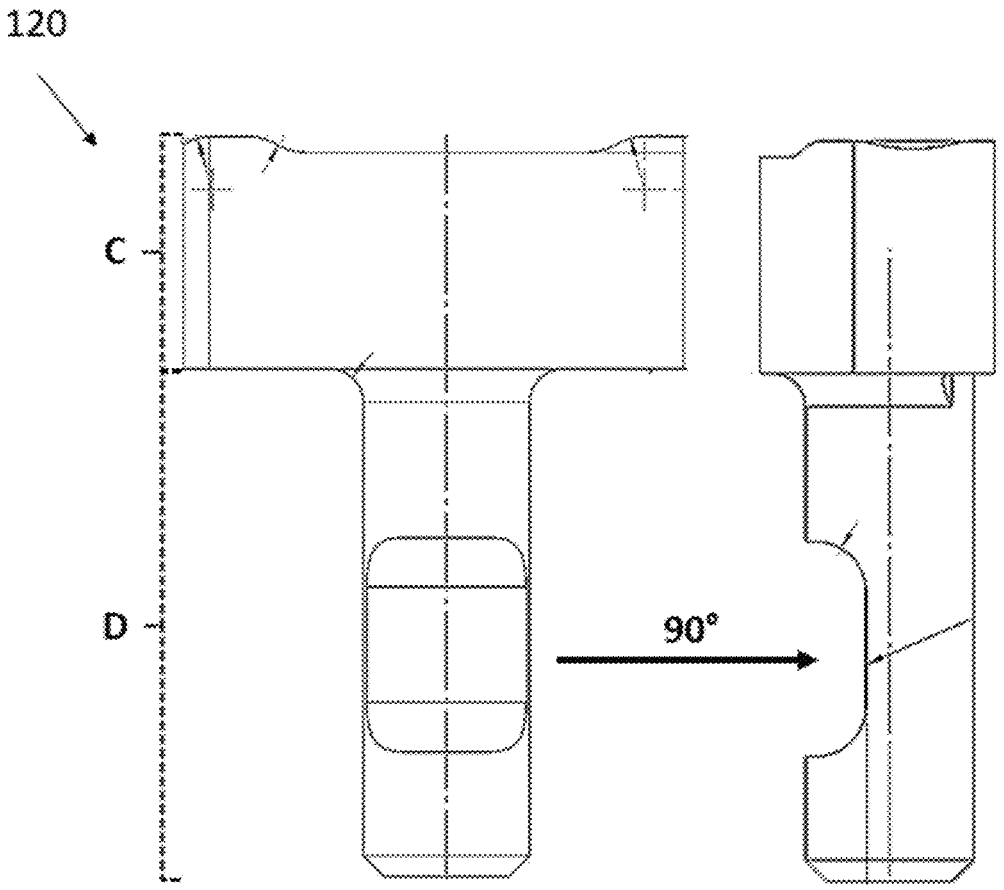
FIG. 12 depicts a side view of the ejector as shown in FIG. 11 and rotated 90°.

FIG. 12 is a side view of the example firearm cartridge ejector 120 shown in FIG. 11 and rotated 90 degrees as indicated by the arrow. As shown in FIGS. 7 and 12, and previously discussed above, the ejector 120 may include an ejector head length C measured from the ejector face to the bottom of the ejector head. In another example, the ejector 120 may also include an ejector stem length D measured from the bottom of the ejector head to the end of the stem.

The foregoing has been presented for purposes of example. The foregoing is not intended to be exhaustive or to limit features to the precise form disclosed. The examples discussed herein were chosen and described in order to explain principles and the nature of various examples and their practical application to enable one skilled in the art to use these and other implementations with various modifications as are suited to the particular use contemplated. The scope of this disclosure encompasses, but is not limited to, any and all combinations, subcombinations, and permutations of structure, operations, and/or other features described herein and in the accompanying drawing figures.

Although examples are described above, features and/or steps of those examples may be combined, divided, omitted, rearranged, revised, and/or augmented in any desired manner. Various alterations, modifications, and improvements will, in view of the foregoing disclosure, readily occur to those skilled in the art. Such alterations, modifications, and improvements are intended to be part of this description, though not expressly stated herein, and are intended to be within the spirit and scope of the disclosure. Accordingly, the foregoing description is by way of example only, and is not limiting.

What is claimed is:

1. A firearm cartridge ejector system comprising:

a bolt; and an ejector configured to eject a cartridge from a firearm bolt, wherein the ejector is movably positioned in the bolt, wherein the ejector further comprises a stem configured to engage the bolt, and an ejector face attached to the stem and configured to engage the cartridge, wherein the ejector face is reniform-shaped and comprising a curvilinear protrusion positioned at a midpoint between a first end of the ejector face and a second end of the ejector face.

2. The system of claim 1, wherein the ejector is a polymer.

3. The system of claim 1, wherein the ejector is a metal or an alloy.

4. The system of claim 1, wherein the ejector face is planar.

5. The system of claim 4, wherein the ejector face is curved.

6. The system of claim 5, wherein the ejector face is concave.

7. The system of claim 1, wherein the stem is positioned perpendicular to the ejector face, and wherein the stem extends proximally from a rear side of the ejector face.

8. The system of claim 7, wherein the stem includes a notch configured to engage an ejector roll pin.

9. The system of claim 1, wherein an interior portion of the ejector face is concave.

10. The system of claim 9, wherein the interior portion of the ejector face further includes a protrusion positioned between a first end of the ejector face and a second end of the ejector face.

11. The system of claim 10, wherein the protrusion is convex and curvilinear.

12. The system of claim 1, wherein the ejector face includes a plurality of ridges and grooves.

13. A firearm comprising the firearm cartridge ejector system of claim 1.

14. A firearm cartridge ejector comprising:

a stem; and an ejector face attached to the stem, wherein the ejector face is reniform-shaped and comprising a curvilinear protrusion positioned at a midpoint between a first end of the ejector face and a second end of the ejector face, wherein the firearm cartridge ejector is configured to engage a bolt or a bolt carrier group.

15. The firearm cartridge ejector of claim 14, wherein the ejector is a polymer, a metal, or an alloy.

16. The firearm cartridge ejector of claim 15, wherein the ejector face is nonplanar.

17. The firearm cartridge ejector of claim 16, wherein an interior portion of the ejector face is concave.

18. The firearm cartridge ejector of claim 17, wherein the interior portion of the ejector face further includes a protrusion positioned between a first end of the ejector face and a second end of the ejector face.

19. The firearm cartridge ejector of claim 18, wherein the protrusion is convex and curvilinear.

20. A firearm including a cartridge extraction system comprising:

a bolt carrier group configured to insert, extract, and eject a firearm cartridge from a weapon, wherein the bolt carrier group further comprises:

a bolt; and an ejector, wherein the ejector further comprises:

an ejector stem configured to slidably engage the bolt; and an ejector face attached to the ejector stem and configured to eject the firearm cartridge from the bolt, wherein the ejector face is reniform-shaped and comprising a curvilinear protrusion positioned at a midpoint between a first end of the ejector face and a second end of the ejector face.

* * * * *